US008449057B2

(12) United States Patent
Matsuo

(10) Patent No.: US 8,449,057 B2
(45) Date of Patent: May 28, 2013

(54) LIQUID EJECTING APPARATUS AND METHOD OF CONTROLLING LIQUID EJECTING APPARATUS

(75) Inventor: Hiroyuki Matsuo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 234 days.

(21) Appl. No.: 12/891,960

(22) Filed: Sep. 28, 2010

(65) Prior Publication Data

US 2011/0096112 A1 Apr. 28, 2011

(30) Foreign Application Priority Data

Oct. 22, 2009 (JP) ..... 2009-243270

(51) Int. Cl.
*B41J 29/38* (2006.01)
*B41J 2/17* (2006.01)

(52) U.S. Cl.
CPC .... *B41J 29/38* (2013.01); *B41J 2/17* (2013.01)
USPC ..... 347/10; 347/94

(58) Field of Classification Search
None
See application file for complete search history.

(56) References Cited

U.S. PATENT DOCUMENTS 6,290,315 B1 * 9/2001 Sayama ..... 347/10

FOREIGN PATENT DOCUMENTS

JP 2006-142588 6/2006

* cited by examiner

*Primary Examiner* — Geoffrey Mruk
(74) *Attorney, Agent, or Firm* — Workman Nydegger

(57) ABSTRACT

The ejection driving pulse is a voltage waveform including: a first variation section; a hold section; and a second variation section. The second variation section includes: a first variation component in which the potential is varied in the second direction from the termination potential of the first variation section; an intermediate hold component in which the termination potential of the first variation component holds for a given time; and a second variation component in which the potential is varied in the second direction from the termination potential of the first variation component. The potential of the intermediate hold component is in the range from 50% to 60% of the potential of the hold section. A potential inclination of the second variation component is steeper than a potential inclination of the first variation component.

3 Claims, 6 Drawing Sheets

LIQUID EJECTING APPARATUS AND METHOD OF CONTROLLING LIQUID EJECTING APPARATUS

The entire disclosure of Japanese Patent Application No: 2009-243270, filed Oct. 22, 2009 are expressly incorporated by reference herein.

BACKGROUND

1. Technical Field

The present invention relates to a liquid ejecting apparatus such as an ink jet printer and a method of controlling the liquid ejecting apparatus, and more particularly, to a liquid ejecting apparatus capable of controlling ejection of a liquid by applying an ejection driving pulse to a pressure generation unit and a method of controlling the liquid ejecting apparatus.

2. Related Art

A liquid ejecting apparatus is an apparatus which includes a liquid ejecting head having nozzles ejecting a liquid and ejects various kinds of liquids from the liquid ejecting head. A representative example of the liquid ejecting apparatus is an image printing apparatus such as an ink jet printer (hereinafter, simply referred to as a printer) which includes an ink jet print head (hereinafter, simply referred to as a print head) as a liquid ejecting head and prints an image or the like by ejecting and landing liquid-like ink from nozzles of the print head on a print medium (landing target) to form dots. In recent years, the liquid ejecting apparatus has been applied not only to the image printing apparatus, but also various manufacturing apparatuses such as an apparatus manufacturing a color filter such as a liquid crystal display.

For example, a printer includes a nozzle row (nozzle group) in which a plurality of nozzles are arranged. In the printer, an ejection driving pulse is applied to a pressure generation unit (for example, a piezoelectric vibrator or a heating device) to drive the pressure generation unit, and a pressure variation is applied to a liquid in a pressure chamber to eject the liquid from the nozzles communicating the pressure chamber. In a printer using a piezoelectric vibrator as a pressure generation unit, in general, ink is ejected from nozzles by first expanding a pressure chamber preliminarily (expansion step), holding the expansion state for a given time (hold step), and then rapidly contracting the pressure chamber (contraction step) to pressurize the ink in the pressure chamber.

FIG. 7 is a diagram for explaining flying of ink droplets when ink is ejected by a known printer. More specifically, FIG. 7 is a diagram illustrating a case where the ink is ejected toward a print medium from the respective nozzles of a nozzle row, when viewed from a direction (transverse direction) intersecting the flying direction of the ink. In the drawing, an upper straight line indicates a nozzle surface of the print head and a lower straight line indicates a print surface of the print medium. The nozzles of #1 to #36 are illustrated among all of the nozzles (for example, the nozzles from #1 to #180) of the nozzle row.

In such a kind of printer, the rear end portion of a preceding main liquid droplet is separated from the main liquid droplet and becomes a satellite liquid droplet in some cases. In particular, when a liquid with a viscosity higher than that of aqueous ink used in a known printer, for example, a liquid with a viscosity of, for example, 8 mPa·s or more is ejected, satellite liquid droplets have a tendency to occur more easily. In a configuration in which printing is executed while print head is moved relative to a print medium, the landing positions of the main liquid droplet and the satellite liquid droplet may be distant from each other. A difference between the landing positions of the main liquid droplet and the satellite liquid droplet may cause deterioration in the quality of a printed image.

In order to resolve this problem, for example, there has been suggested a configuration in which a main liquid droplet is ejected in a contraction step by a first waveform component, and then a pressure chamber is expanded by a second waveform component with the ejection of the main liquid droplet at a time, at which a meniscus is moved toward the pressure chamber, depending on the inherent vibration of the ink in the pressure chamber (re-expansion step). Then, in this configuration, pressure variation by the expansion of the pressure chamber is superimposed in the vibration of the meniscus, the vibration is oscillated, the flying speed of the satellite liquid droplet flying after the main liquid droplet is increased by the oscillation (for example, see JP-A-2006-142588). In this way, by increasing the flying speed of the satellite liquid droplet, the landing positions of the main liquid droplet and the satellite liquid droplet on the print medium can be closer to each other.

In the configuration disclosed in JP-A-2006-142588, however, the pressure chamber is contracted in one motion from the maximum volume to the minimum volume in the contraction step. Therefore, since the flying speed of the main liquid droplet is increased and timing of the re-expansion step after the contraction step is measured, the satellite liquid droplet is ejected after a pause from the ejection of the main liquid droplet. For this reason, the satellite liquid droplet may not follow the main liquid droplet. Therefore, a problem may still arise in that the difference between the landing positions may occur on the print medium.

SUMMARY

An advantage of some aspects of the invention is that it provides a liquid ejecting apparatus capable of more reliably preventing a difference between the landing positions of a satellite liquid droplet and a main liquid droplet on a landing target and a method of controlling the liquid ejecting apparatus.

According to an aspect of the invention, there is provided a liquid ejecting apparatus including: a liquid ejecting head which includes a nozzle ejecting a liquid, a pressure chamber communicating with the nozzle, and a pressure generation unit applying pressure variation to the liquid of the pressure chamber and which ejects the liquid from the nozzle by an operation of the pressure generation unit; a driving signal generation unit which generates a driving signal containing an ejection driving pulse used to eject the liquid from the nozzle by driving the pressure generation unit; and a movement unit which moves the liquid ejecting head relative to a landing target. A liquid droplet is ejected from the nozzle and is landed on the landing target, while the movement unit moves the liquid ejecting head relative to the landing target. The ejection driving pulse is a voltage waveform including: a first variation section in which a potential is varied in a first direction to vary a volume of the pressure chamber; a hold section in which the volume of the pressure chamber varied in the first variation section holds for a given time and a termination potential of the first variation section is constant; and a second variation section in which the potential is varied in a second direction opposite to the first direction to vary the volume of the pressure chamber varied in the first variation section. The second variation section includes: a first variation component in which the potential is varied in the second direction from the termination potential of the first variation section; an intermediate hold component in which the termination potential of the first variation component holds for a given time; and a second variation component in which the potential is varied in the second direction from the termination potential of the first variation component. The potential of the intermediate hold component is in the range from 50% to 60% of the potential of the hold section. A potential inclination of the second variation component is steeper than a potential inclination of the first variation component.

According to this aspect of the invention, the second variation section of the ejection driving pulse includes the first variation component in which the potential is varied in the second direction from the termination potential of the first variation section, the intermediate hold component in which the termination potential of the first variation component holds for the given time, and the second variation component in which the potential is varied in the second direction from the termination potential of the first variation component. The potential of the intermediate hold component is in the range from 50% to 60% of the potential of the hold section. The potential inclination of the second variation component is steeper than the potential inclination of the first variation component. Therefore, the flying speed of the satellite liquid droplet generated upon ejecting the liquid from the nozzle can be more rapid than that of the main liquid droplet. With such a configuration, a difference between the landing positions of the main liquid droplet and the satellite liquid droplet on the landing target is suppressed. That is, by pressuring the liquid in the pressure chamber by the first variation component so that a liquid column in the middle portion of the meniscus is extruded toward the ejection side and then holding the pressurization of the liquid in the pressure chamber by the intermediate hold component, the flying speed of the main liquid droplet is suppressed. Thereafter, when the meniscus is rapidly extruded toward the ejection side by the second variation component having the potential inclination steeper than the potential inclination of the first variation component, the satellite liquid droplet is accelerated. As a consequence, the flying speed of the satellite liquid droplet can be made more rapid than the flying speed of the main liquid droplet.

In the liquid ejecting apparatus having the above-described configuration, a time from an initial end and a termination end of the intermediate hold component may be greater than 0 and 0.12 Tc or less on the assumption that a period of pressure vibration occurring in the liquid of the pressure chamber is Tc.

With such a configuration, since time from an initial end and a termination end of the intermediate hold component is set to be greater than 0 and 0.12 Tc or less, the time from the ejection of the main liquid droplet to the ejection of the satellite liquid droplet can be suppressed to the minimum. Accordingly, the satellite liquid droplet can be made closer to the main liquid droplet.

In the liquid ejecting apparatus having the above-described configuration, a time from an initial end to a termination end of the second variation component may be 0.08 Tc or more.

With such a configuration, since the time from the initial end to the termination end of the second variation component is set to be 0.08 Tc or more, the flying of the satellite liquid droplet can be stabilized. That is, in order to stabilize the flying of the satellite liquid droplet, it is necessary to appropriately set the time in consideration of the influence of the vibration of the meniscus based on Tc. Here, however, when the potential inclination of the second variation component is steeper than the potential inclination of the first variation component, the flying speed of the satellite liquid droplet Ds is increased more than is necessary, and thus a flying direction may be curved. In this case, there is a possibility that the landing position of the main liquid droplet is distant from the landing position of the satellite liquid droplet. By contrast, when the potential inclination of the second variation component is set to be steeper than the potential inclination of the first variation component and the time from the initial end to the termination end of the second variation component is set to be 0.08 Tc or more, the flying direction can be stabilized without the unnecessary increase in the flying speed of the satellite liquid droplet.

According to another aspect of the invention, there is provided a method of controlling a liquid ejecting apparatus including a liquid ejecting head which includes a nozzle ejecting a liquid, a pressure chamber communicating with the nozzle, and a pressure generation unit applying pressure variation to the liquid of the pressure chamber and which ejects the liquid from the nozzle by an operation of the pressure generation unit, a driving signal generation unit which generates a driving signal containing an ejection driving pulse used to eject the liquid from the nozzle by driving the pressure generation unit, and a movement unit which moves the liquid ejecting head relative to a landing target, the liquid ejecting apparatus ejecting a liquid droplet from the nozzle and is landed on the landing target, while the movement unit moves the liquid ejecting head relative to the landing target. The ejection driving pulse is a voltage waveform including a first variation section in which a potential is varied in a first direction, a hold section in which a termination potential of the first variation section is constant, and a second variation section in which the potential is varied in a second direction opposite to the first direction. The second variation section includes a first variation component in which the potential is varied in the second direction from the termination potential to a halfway potential of the first variation section, an intermediate hold component in which the termination potential of the first variation component holds for a given time, and a second variation component in which the potential is varied in the second direction from the termination potential of the first variation component. The potential of the intermediate hold component is in the range from 50% to 60% of the potential of the hold section. A potential inclination of the second variation component is steeper than a potential inclination of the first variation component. The method includes: a first variation step of varying the volume of the pressure chamber in the first variation section; a hold step of holding the volume of the pressure chamber varied in the first variation step for a predetermined time in the hold section; and a second variation step of varying the volume of the pressure chamber varied in the first variation step in the second variation section. The second variation step includes: a first variation action of varying the volume of the pressure chamber varied in the first variation step to a halfway volume in the first variation component; a hold action of holding the volume of the pressure chamber varied in the first variation action for a given time; and a second variation action of varying the volume of the pressure chamber holding in the hold action in the second variation component. A variation speed of the volume of the pressure chamber in the second variation action is more rapid than a variation speed of the volume of the pressure chamber in the first variation action.

According to this aspect of the invention, the second variation section of the ejection driving pulse includes the first variation component in which the potential is varied in the second direction from the termination potential of the first variation section, the intermediate hold component in which the termination potential of the first variation component holds for the given time, and the second variation component in which the potential is varied in the second direction from the termination potential of the first variation component. The potential of the intermediate hold component is in the range from 50% to 60% of the potential of the hold section. The potential inclination of the second variation component is steeper than the potential inclination of the first variation component. Since the variation speed of the volume of the pressure chamber in the second variation action is more rapid than the variation speed of the volume of the pressure chamber in the first variation action, the flying speed of the satellite liquid droplet generated upon ejecting the liquid from the nozzle can be made more rapid than that of the main liquid droplet. Accordingly, the difference between the landing positions of the main liquid droplet and the satellite liquid droplet on the landing target is suppressed. That is, by pressuring the liquid in the pressure chamber by the first variation component so that a liquid column in the middle portion of the meniscus is extruded toward the ejection side and then holding the pressurization of the liquid in the pressure chamber by the intermediate hold component, the flying speed of the main liquid droplet is suppressed. Thereafter, when the meniscus is rapidly extruded toward the ejection side by the second variation component having the potential inclination steeper than the potential inclination of the first variation component, the satellite liquid droplet is accelerated. As a consequence, the flying speed of the satellite liquid droplet can be made more rapid than the flying speed of the main liquid droplet.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the accompanying drawings. Although the following embodiment is described as a preferred specific example of the invention in various forms, the scope of the invention is not limited to the forms as long as no description limiting the invention is mentioned. In the following description, an ink jet printing apparatus (hereinafter, referred to as a printer) will be described as an example of a liquid ejecting apparatus of the invention.

Figure 1:
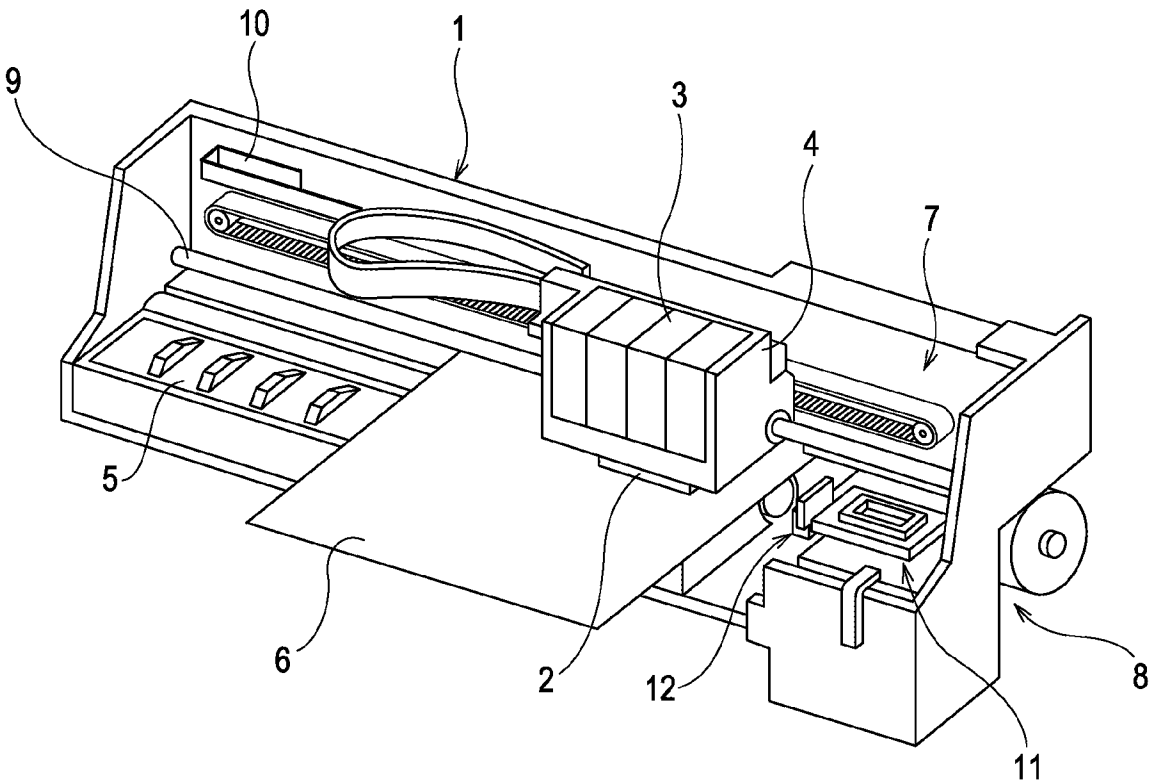
FIG. 1 is a perspective view illustrating the overall configuration of a printer.

FIG. 1 is a perspective view illustrating the configuration of a printer 1. The printer 1 is mounted with a print head 2 as a liquid ejecting head and includes a carriage 4 detachably mounted with ink cartridges 3, a platen 5 disposed below the print head 2, a carriage moving mechanism 7 (which is a kind of movement unit) reciprocating the carriage 4 in a sheet surface direction of a print sheet 6 (which is a kind of landing target) as a printing medium, that is, a main scanning direction, and a sheet feeding mechanism 8 feeding the print sheet 6 in a sub-scanning direction perpendicular to the main scanning direction.

The carriage 4 is mounted on a guide rod 9 installed so as to be shaft-supported in the main scanning direction. Therefore, the carriage 4 is moved along the guide rod 9 in the main scanning direction by an operation of the carriage moving mechanism 7. The position of the carriage 4 in the main scanning direction is detected by a linear encoder 10. The detection signal, that is, an encoder pulse, is transmitted to a control unit 41 (see FIG. 3) of a printer controller 35. With such a configuration, the control unit 41 can control a printing process (ejecting process) executed by the print head 2, while recognizing the scanning position of the carriage 4 (print head 2) on the basis of the encoder pulse from the linear encoder 10.

A home position serving as a base point of the scanning is set in an end region outside a print area within the movement range of the carriage 4. A capping member 11 sealing a nozzle formation surface (nozzle substrate 21: see FIG. 2) of the print head 2 and a wiper member 12 cleaning the nozzle formation surface are disposed at the home position according to this embodiment. The printer 1 is configured to be capable of executing so-called bi-directional printing of characters, an image, or the like on the print sheet 6 in both directions at forward movement time, at which the carriage 4 (print head 2) is moved toward the opposite end of the home position and at backward movement time, at which the carriage 4 is returned from the opposite end to the home position.

Figure 2:
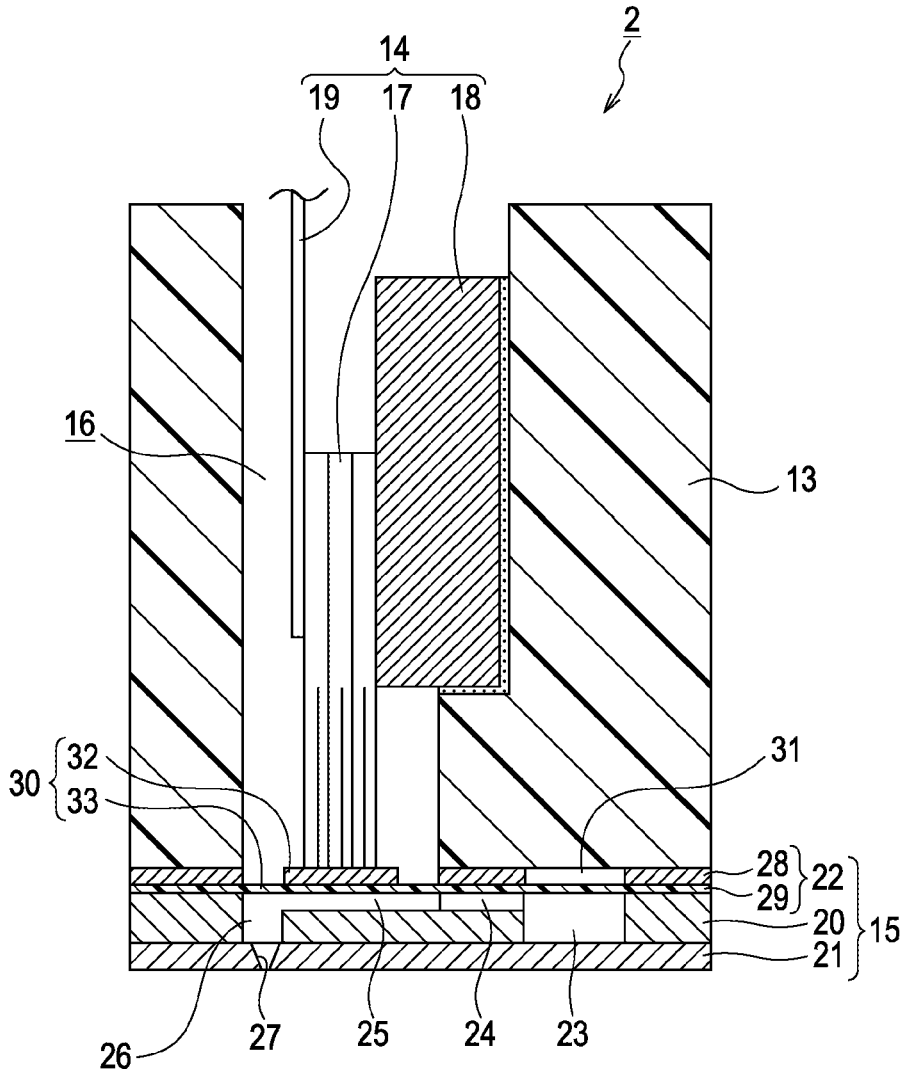
FIG. 2 is a sectional view illustrating the configuration of the main units of a print head.

FIG. 2 is a sectional view illustrating the configuration of the main units of the print head 2. The print head 2 includes a case 13, a vibrator unit 14 received in the case 13, and a passage unit 15 joined to the bottom surface (front end surface) of the case 13. The case 13 is formed of, for example, epoxy-based resin. A receiving hollow portion 16 is formed in the case 13 to receive the vibrator unit 14. The vibrator unit 14 includes a piezoelectric vibrator 17 serving as a kind of pressure generation unit, a fixing plate 18 to which the piezoelectric vibrator 17 joins, and a flexible cable 19 supplying a driving signal or the like to the piezoelectric vibrator 17. The piezoelectric vibrator 17 is of a laminated type manufactured by separating a piezoelectric plate, which is formed by alternately laminating piezoelectric layers and electrode layers, in a pectinate form and is a vertical vibration mode piezoelectric vibrator expanded or contracted in a direction perpendicular to the lamination direction.

The passage unit 15 is formed by joining the nozzle substrate 21 to one surface of the passage substrate 20 and joining an elastic plate 22 on the other surface of the passage substrate 20. A reservoir 23, an ink supply port 24, a pressure chamber 25, a nozzle communication opening 26, and a nozzle 27 are formed in the passage unit 15. A series of ink passages from the ink supply port 24 to the nozzle 27 via the pressure chamber 25 and the nozzle communication opening 26 is formed to correspond to each nozzle 27.

The nozzle substrate 21 is a plate member formed of a metal plate made of stainless steel, a silicon single-crystal substrate, or the like, where a plurality of the nozzles 27 is punched in a row form at a pitch (for example, 180 dpi) corresponding to a dot formation density. In the nozzle substrate 21, a plurality of rows (nozzle groups) of the nozzles 27 is formed and 180 nozzles 27, for example, constitute one nozzle row. The print head 2 according to this embodiment is configured to mount four ink cartridges 3 storing ink (which is a kind of liquid) of respective different colors, specifically, a total of four cyan (C) ink, magenta (M) ink, yellow (Y) ink, and black (K) ink. Therefore, a total of four nozzle rows are formed in the nozzle substrate 21 so as to correspond to these colors.

The elastic plate 22 has a double structure in which an elastic film 29 is laminated on the surface of a support plate 28. In this embodiment, the elastic plate 22 is manufactured using a composite plate member formed by forming a stainless steel plate, which is a kind of metal plate, as the support plate 28 and laminating a resin film as the elastic film 29 on the surface of the support plate 28. The elastic plate 22 is provided with a diaphragm portion 30 varying the volume of the pressure chamber 25. The elastic plate 22 is provided with a compliance portion 31 sealing a part of the reservoir 23.

The diaphragm portion 30 is manufactured by partially removing the support plate 28 by etching. That is, the diaphragm portion 30 includes an island portion 32 to which the front end surface of the piezoelectric vibrator 17 joins and a thin-walled elastic portion 33 surrounding the island portion 32. The compliance portion 31 is manufactured by removing the support plate 28 of a region facing an opening surface of the reservoir 23 by etching, as in the diaphragm portion 30. The compliance portion 31 functions as a damper absorbing a variation in the pressure of a liquid stored in the reservoir 23.

Since the front end surface of the piezoelectric vibrator 17 joins to the island portion 32, the volume of the pressure chamber 25 can be varied by expansion or contraction of a free end portion of the piezoelectric vibrator 17. With the variation in the volume, a variation in the pressure of the ink in the pressure chamber 25 is caused. The print head 2 ejects ink droplets from the nozzles 27 using the variation in the pressure.

Figure 3:
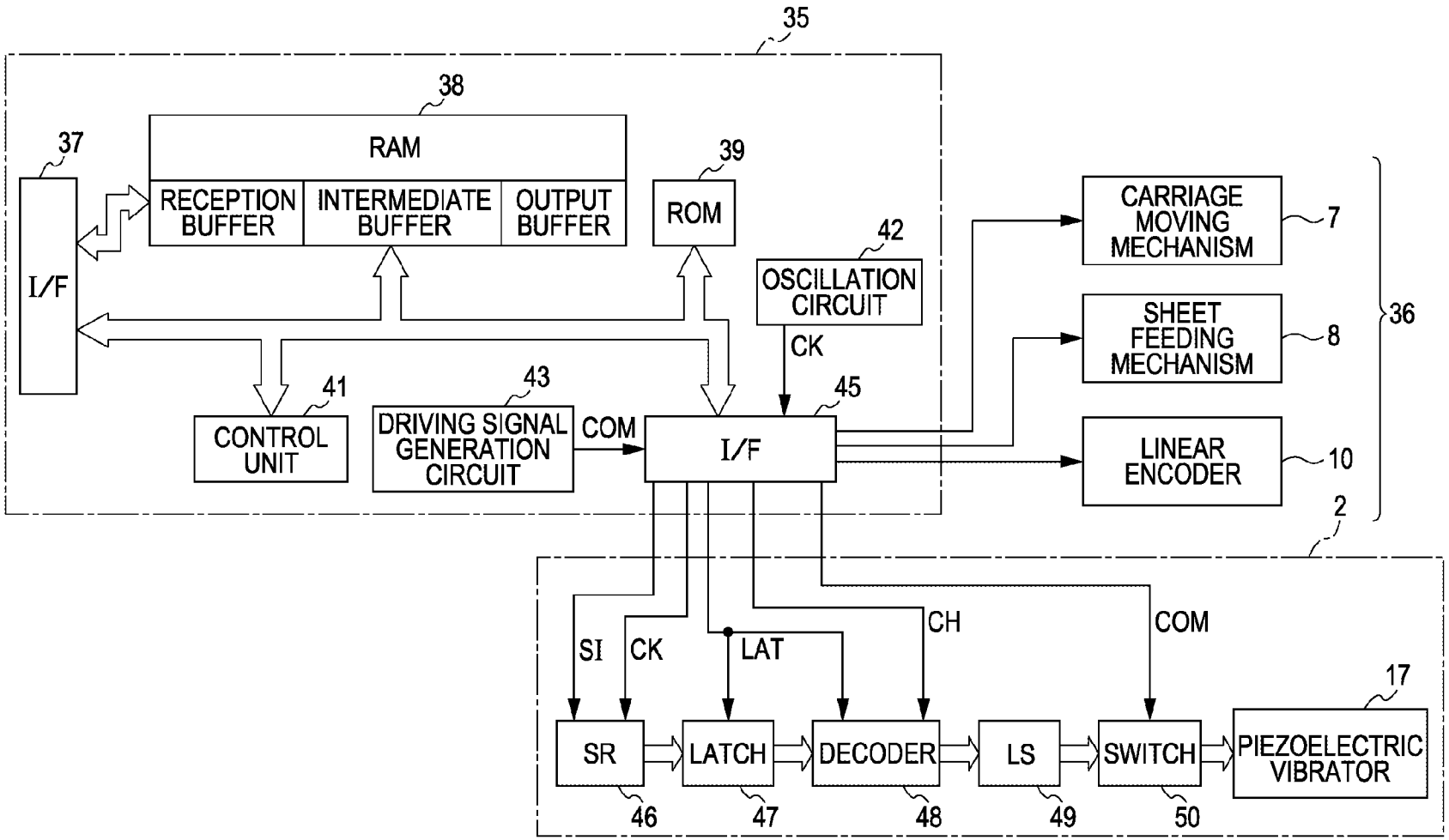
FIG. 3 is a block diagram illustrating the electric configuration of the printer.

FIG. 3 is a block diagram illustrating the electric configuration of the printer 1. The printer 1 includes the printer controller 35 and a print engine 36. The printer controller 35 includes an external interface (external I/F) 37 into which print data or the like is input from an external apparatus such as a host computer, a RAM 38 which stores a variety of data or the like, a ROM 39 which stores a control routine to process a variety of data, the control unit 41 which controls each unit, an oscillation circuit 42 which generates a clock signal, a driving signal generation circuit 43 (which is a kind of driving signal generation unit) which generates a driving signal to be supplied to the print head 2, and an internal interface (internal I/F) 45 which outputs pixel data obtainable by developing the print data into each dot and the driving signal to the print head 2.

The control unit 41 outputs a head control signal used to control the operation of the print head 2 to the print head 2 or outputs a control signal used to generate a driving signal COM to the driving signal generation circuit 43. Examples of the head control signal include a transmission clock CLK, pixel data SI, a latch signal LAT, and a change signal CH1. The latch signal or the change signal defines the supply timing of each pulse organizing the driving signal COM.

The control unit 41 executes a color conversion process of converting the RGB color system to the CMYK color system, a halftone process of reducing multiple gray-scale data down to a predetermined gray scale, and a dot pattern development process of arranging the data subjected to the halftone process in a predetermined arrangement form in each kind of ink (each nozzle row) and developing the data into dot pattern data to generate the pixel data SI used to control the ejection of the print head 2. The pixel data SI is data regarding pixels of an image to be printed and is a kind of ejection control information. Here, the pixels indicate a dot formation area imaginarily defined on a print medium such as a print sheet which is a landing target. The pixel data SI according to the invention is formed from gray scale data regarding whether dots formed on the print medium are formed (or whether ink is ejected) and regarding the size of the dot (amount of ink ejected). In this embodiment, the pixel data SI is organized by binary gray-scale data having a total of two bits. The 2-bit gray scale values each include [00] indicating non-printing (non-vibration) in which no ink is ejected, [01] indicating printing of a small dot, [10] indicating printing of a middle dot, and [11] indicating printing of a large dot. Accordingly, the printer according to this embodiment can execute printing in four gray scales.

Next, the configuration of the print engine 36 will be described. The print engine 36 includes the print head 2, the carriage moving mechanism 7, the sheet feeding mechanism 8, and the linear encoder 10. The print head 2 includes a plurality of shift registers (SR) 46, a plurality of latches 47, a plurality of decoders 48, a plurality of level shifters (LS) 49, a plurality of switches 50, and a plurality of piezoelectric vibrators 17 so as to correspond to the nozzles 27, respectively. The pixel data (SI) from the printer controller 35 is synchronized with the clock signal (CK) from the oscillation circuit 42 and is transmitted in series to the shift registers 46.

The latch 47 is electrically connected to the shift register 46. Therefore, when the latch signal (LAT) is input from the printer controller 35, the latch 47 latches the pixel data of the shift register 46. The pixel data latched by the latch 47 is input to the decoder 48. The decoder 48 translates the 2-bit pixel data and generates pulse selection data. The pulse selection data according to this embodiment is formed by data of a total of two bits.

The decoder 48 outputs the pulse selection data to the level shifter 49 when receiving the latch signal (LAT) or a channel signal (CH). In this case, the pulse selection data is input to the level shifter 49 in order from an upper bit. The level shifter 49 functions as a voltage amplifier. Therefore, when the pulse selection data is "1", the level shifter 49 outputs a voltage enabling the drive of the switch 50, for example, an electric signal boosted to a voltage of about several tens of volts. The pulse selection data of "1" boosted by the level shifter 49 is supplied to the switch 50. The driving signal COM from the driving signal generation circuit 43 is supplied to the input side of the switch 50, and the piezoelectric vibrator 17 is connected to the output side of the switch 50.

The pulse selection data is used to control the operation of the switch 50, that is, the supply of an ejection pulse of the driving signal to the piezoelectric vibrator 17. For example, for a period in which the pulse selection data input to the switch 50 is "1", the switch 50 is in a connection state, the corresponding ejection pulse is supplied to the piezoelectric vibrator 17, and the potential level of the piezoelectric vibrator 17 is varied in accordance with the waveform of the ejection pulse. On the other hand, in a period in which the pulse selection data is "0", an electric signal enabling the operation of the switch 50 is not output from the level shifter 49. Therefore, since the switch 50 is in a disconnection state, no ejection pulse is supplied to the piezoelectric vibrator 17.

Figure 4:
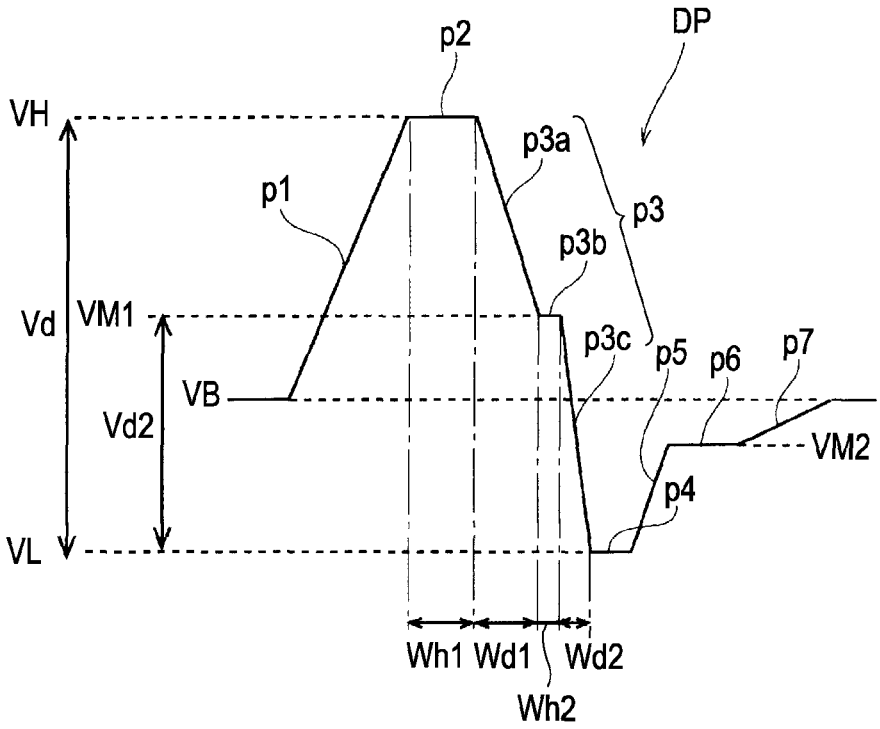
FIG. 4 is a diagram illustrating the waveform structure of an ejection driving pulse.

FIG. 4 is a diagram illustrating the waveform structure of an ejection driving pulse DP of the driving signal COM generated by the driving signal generation circuit 43.

As shown in FIG. 4, the ejection driving pulse DP includes a preliminary expansion section p1 (corresponding to a first variation section), an expansion hold section p2 (corresponding to a hold section), a contraction section p3 (corresponding to a second variation section), a contraction hold section p4, a vibration-suppression expansion section p5, a vibration-suppression hold section p6, and a return expansion section p7. The preliminary expansion section p1 is a waveform section in which a potential is varied (increases) at a constant inclination in a plus direction (corresponding to a first direction) from a reference potential VB to an expansion potential VH. The expansion hold section p2 is a waveform section in which the expansion potential VH, which is the termination voltage of the preliminary expansion section p1, is constant. The contraction section p3 is a waveform section in which the potential is varied (drops) in a minus direction (corresponding to a second direction) from the expansion potential VH to a contraction potential VL. The contraction hold section p4 is a waveform section in which the contraction potential VL is constant. The vibration-suppression expansion section p5 is a waveform section in which the potential increases at a constant inclination in the plus direction from the contraction potential VL to a vibration-suppression expansion potential VM2. The vibration-suppression hold section p6 is a waveform section in which the vibration-suppression expansion potential VM2 holds. The return expansion section p7 is a waveform section in which the potential returns from the vibration-suppression expansion potential VM2 to the reference potential VB.

The contraction section p3 includes a first contraction component p3*a* (corresponding to a first variation component) in which the potential is varied (drops) in the minus direction from the expansion potential VH, an intermediate hold component p3*b* (corresponding to an intermediate hold component) in which an intermediate potential VM1, which is the termination potential of the first contraction component p3*a*, holds for a given time, and a second contraction component p3*c* (corresponding to a second variation component) in which the potential is varied (drops) in the minus direction from the intermediate potential VM1. That is, the contraction section p3 is configured such that the variation in the potential stops only for a short time while the potential is varied from the expansion potential VH to the contraction potential VL.

The intermediate potential VM1, which is the potential of the intermediate hold component p3*b*, is set to be in the range from 50% to 60% of the expansion potential VH, which is the potential of the expansion hold section p2. In other words, a potential difference Vd2 between the intermediate potential VM1 and the contraction potential VL is set to be in the range from 50% to 60% of a driving voltage Vd (potential difference between the expansion potential VH, which is the maximum potential, and the contraction potential VL, which is the minimum potential) of the ejection driving pulse DP. The potential inclination of the second contraction component p3*c* is set to be steeper than that of the first contraction component p3*a*. Specifically, the potential inclination of the second contraction component p3*c* is about twice the potential inclination of the first contraction component p3*a*. In addition, a time from the initial end to the termination end of the intermediate hold component p3*b*, that is, a hold time Wh2 is set to be in the range of expression (1) on the assumption that a vibration period of the pressure vibration occurring in the ink of the pressure chamber 25 is Tc.

$$0<Wh2\leqq 0.12Tc \quad (1)$$

In addition, the time from the initial end to the termination end of the second contraction component p3*c*, that is, a hold time Wd2 is set to a value in the range of Expression (2).

$$Wd2\geqq 0.08Tc \quad (2)$$

In this expression, Tc is uniquely determined depending on the shape, size, rigidity, and the like of each constituent member such as the nozzle 27, the pressure chamber 25, the ink supply port 24, and the piezoelectric vibrator 17. For example, the inherent vibration period Tc can be expressed as Expression (3).

$$Tc=2\pi\sqrt{[((Mn\times Ms)/(Mn+Ms))\times Cc]} \quad (3)$$

In Expression (3), Mn denotes inertance in the nozzle 27, Ms denotes inertance in the ink supply port 24, Cc denotes the compliance (indicating a variation in the volume per about unit pressure and softness degree) of the pressure chamber 25. In Expression (3), the inertance M indicates that the liquid readily moves in the passage such as the nozzle 27. In other words, the inertance M is the mass of a liquid per unit area. On the assumption that the density of a liquid is ρ, the cross-section area of a surface perpendicular to a downflow direction of a liquid in a passage is S, and the length of the passage is L, the inertance M can be expressed as Expression (4).

$$M=(\rho\times L)/S \quad (4)$$

Tc may not be defined as in Expression (3), but may be a vibration period of the pressure chamber 25 of the print head 2.

Figure 5A:
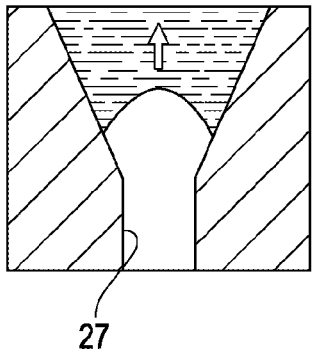
FIGS. 5A to 5D are sectional views illustrating the vicinity of a nozzle to explain movement of a meniscus when ink is ejected from the nozzle.

When the ejection driving pulse DP having the above-described structure is supplied to the piezoelectric vibrator 17, the piezoelectric vibrator 17 is first contracted in an element longitudinal direction in the preliminary expansion section p1, and thus the pressure chamber 25 is expanded from a reference volume corresponding to the reference potential VB to an expansion volume corresponding to the expansion potential VH (first variation step). As shown in FIG. 5A, the surface (meniscus) of the ink in the nozzle 27 is considerably drawn toward the pressure chamber 25 (an upper side of the drawing) by this expansion and the ink in the pressure chamber 25 is supplied from the reservoir 23 via the ink supply port 24. Then, the expansion state of the pressure chamber 25 holds for the entire supply period of the expansion hold section p2 (hold step).

Figure 5B:
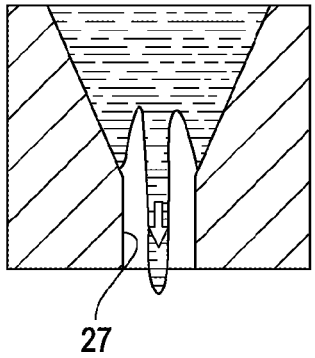
Figure 5C:
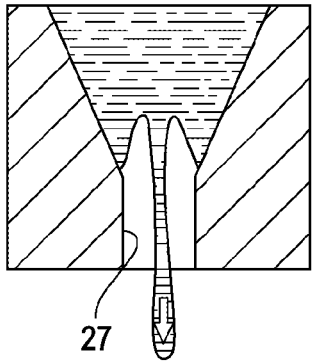

After the expansion state holds by the expansion hold section p2, the contraction section p3 is supplied and thus the piezoelectric vibrator 17 is expanded in response to the supply of the expansion section p3. Then, the pressure chamber 25 is contracted from the expansion volume to a contraction volume corresponding to the contraction potential VL (second variation step). Since the contraction section p3 includes the first contraction component p3*a*, the intermediate hold component p3*b*, and the second contraction component p3*c*, as described above, the pressure chamber 25 is contracted from the expansion volume to an intermediate volume corresponding to the intermediate potential VM1 by the first contraction component p3*a* in the second variation step (first variation action). In this way, the ink in the pressure chamber 25 is pressurized, as shown in FIG. 5B, the middle portion of the meniscus is extruded toward an ejection side (a lower side of the drawing) and thus the extruded portion grows in the form of a liquid column. Next, the intermediate hold component p3*b* is supplied, and then the intermediate volume is held only for the time Wh2 (hold action). Then, the expansion of the piezoelectric vibrator 17 temporarily stops. Meanwhile, as shown in FIG. 5C, the liquid column in the middle portion of the meniscus grows in the ejection direction by the inertia force. However, since the ink in the pressure chamber 25 is not pressurized for a while, the liquid column is thus suppressed from growing. As a consequence, the flying speed of the main liquid droplet subsequently ejected is suppressed.

Figure 5D:
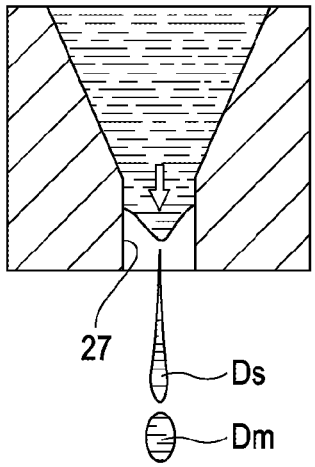

After being held by the intermediate hold component p3*b*, the piezoelectric vibrator 17 is expanded more rapidly by the second contraction component p3*c* than by the first contraction component p3*a*, and then the volume of the pressure chamber 25 is rapidly pressurized from the intermediate volume to the contraction volume (second variation action). That is, the variation speed of the volume of the pressure chamber in the second variation action is more rapid than the variation speed of the volume of the pressure chamber in the first variation action. In this way, as shown in FIG. 5D, the entire meniscus is rapidly extruded in the ejection direction and the rear end portion of the liquid column is accelerated. Then, the liquid column is separated from the meniscus, the separated portion is ejected as an ink droplet from the nozzle 27, and the separated portion flies. The ejected ink droplet is formed by a preceding main liquid droplet Dm and a subsequent satellite liquid droplet Ds separated from the main liquid droplet Dm.

In this embodiment, after the liquid column in the middle portion of the meniscus is extruded toward the ejection side by pressurizing the ink in the pressure chamber 25 by the first contraction component p3*a* (first variation action), the pressurization of the ink in the pressure chamber 25 holds by the intermediate hold component p3*b* (hold action). Therefore, the flying speed of the main liquid droplet Dm is suppressed. On the contrary, the rear end portion of the liquid column becoming the satellite liquid droplet Ds is accelerated by the second contraction component p3. Accordingly, the flying speed of the satellite liquid droplet Ds is more rapid than the flying speed of the main liquid droplet Dm. In this way, while the liquid droplet is ejected from the nozzle 27 and is landed on the print surface of the print medium, the satellite liquid droplet Ds approaches the main liquid droplet Dm. In this way, a dot formed when the main liquid droplet Dm and the satellite liquid droplet Ds are landed on the print surface of the print medium comes to have a form close to a circle or an ellipse.

After the contraction section p3, the contraction state of the pressure chamber 25 holds for a given time by the contraction hold section p4. Meanwhile, the pressure of the ink in the pressure chamber 25, which is decreased by the ejection of the ink, is increased again by the inherent vibration. The vibration-suppression expansion section p5 is applied to the piezoelectric vibrator 17 at the time at which the pressure of the ink is increased, and thus the pressure chamber 25 is expanded from the contraction volume to the vibration-suppression expansion volume. Then, the pressure variation (residual vibration) of the ink in the pressure chamber 25 is reduced. The vibration-suppression expansion volume of the pressure chamber 25 is held for a given time by the vibration-suppression hold section p6. Thereafter, the pressure chamber 25 is expanded and the volume of the pressure chamber 25 is returned gradually to the normal volume by the return expansion section p7.

In this way, the contraction section p3 of the ejection driving pulse DP includes the first contraction component p3*a*, the intermediate hold component p3*b*, and the second contraction component p3*c*. The potential of the intermediate hold component p3*b* is in the range from 50% to 60% of the potential of the expansion hold section p2. The potential inclination of the second contraction component p3*c* is set to be steeper than the potential inclination of the first contraction component p3*a*. Therefore, it can be known that the flying speed of the satellite liquid droplet Ds generated upon ejecting the ink from the nozzle 27 is more rapid than that of the main liquid droplet liquid Dm. In this way, a difference between the landing positions of the main liquid droplet and the satellite liquid droplet on the print medium which is the landing target is suppressed. As a consequence, the quality of a printed image can be prevented from deteriorating due to deviation in the landing positions of the main liquid droplet and the satellite liquid droplet.

Since the hold time Wh2 from the initial end to the termination end of the intermediate hold component p3*b* is set to be greater than 0 and equal to or less than 0.12 Tc, a time difference between the ejection of the main liquid droplet Dm and the ejection of the satellite liquid droplet Ds is suppressed to the minimum. Therefore, the satellite liquid droplet Ds can be made closer to the main liquid droplet Dm. As a consequence, the difference between the landing positions can be reliably suppressed.

In this embodiment, since the hold time Wd2 from the initial end to the termination end of the second hold component p3*c* is set to be 0.08 Tc or more, the satellite liquid droplet Ds is suppressed from being accelerated more than is necessary. Therefore, the flying of the satellite liquid droplet Ds can be stabilized. That is, in order to stabilize the flying of the satellite liquid droplet Ds, it is necessary to appropriately set the time in consideration of the influence of the vibration of the meniscus based on the inherent vibration period Tc. However, when the potential inclination of the second contraction component p3*c* is steeper than the potential inclination of the first contraction component p3*a*, the flying speed of the satellite liquid droplet Ds is increased more than is necessary, and thus a flying direction may be curved. In this case, there is a possibility that the landing position of the main liquid droplet Dm is distant from the landing position of the satellite liquid droplet Ds. By contrast, when the potential inclination of the second contraction component p3*c* is set to be steeper than the potential inclination of the first contraction component p3*a* and the hold time Wd2 from the initial end to the termination end of the second contraction component p3*c* is set to be 0.08 Tc or more, the flying direction can be stabilized without the unnecessary increase in the flying speed of the satellite liquid droplet Ds. Moreover, by stabilizing the flying of the satellite liquid droplet Ds, the satellite liquid droplet Ds can be landed on a target landing position on the print medium.

Figure 6:
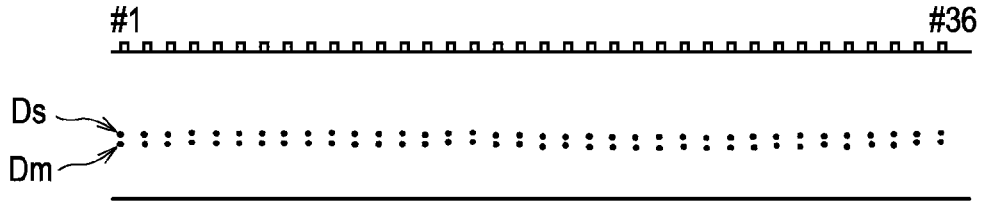
FIG. 6 is a schematic view illustrating a case where ink is ejected toward a print medium from respective nozzles of a nozzle row in the printer according to the invention.
Figure 7:
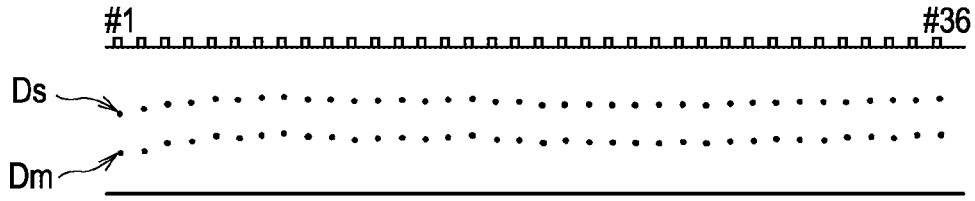
FIG. 7 is a schematic view illustrating a case where ink is ejected toward a print medium from respective nozzles of a nozzle row in the printer according to a known example.

FIG. 6 is a diagram illustrating a case where ink is ejected toward the print medium from the respective nozzles 27 of a nozzle row, when viewed from a direction intersecting the flying direction of the ink. In the drawing, an upper straight line indicates a nozzle surface (surface of the nozzle substrate 21 on the ejection side) of the print head 2 and a lower straight line indicates a print surface of the print medium (print sheet 6). The nozzles 27 of #1 to #36 are illustrated among all of the nozzles 27 (for example, the nozzles 27 from #1 to #180) of the nozzle row.

In the printer 1, compared to a known printer in which the main liquid Dm and the satellite liquid droplet Ds fly apart, the flying speed of the satellite liquid droplet Ds is made more rapid than the flying speed of the main liquid droplet Dm and thus the distance between the main liquid droplet Dm and the satellite liquid droplet Ds can be reduced, when the ink (the main liquid droplet Dm and the satellite liquid droplet Ds) ejected from each nozzle 27 is observed. Accordingly, the dot shape formed when the liquid droplets are landed on the print medium can be improved.

The invention is not limited to the above-described embodiment, but may be modified in various forms within the scope described in the appended claims.

The waveform structure of the ejection driving pulse DP is not limited to the structure exemplified in the embodiment. The ejection driving pulse may be a voltage waveform that includes at least: the first variation section in which the potential is varied in the first direction to vary the volume of the pressure chamber 25; the hold section in which the volume of the pressure chamber 25 varied in the first variation section holds for a given time and the termination potential of the first variation section is constant; and the second variation section in which the potential is varied in the second direction opposite to the first direction to vary the volume of the pressure chamber 25 varied in the first variation section.

In the above-described embodiment, the so-called vertical vibration mode piezoelectric vibrator 17 is used as a pressure generation unit. However, the invention is not limited thereto. For example, a bending vibration mode piezoelectric element may be used. In this case, the exemplified ejection driving pulse DP becomes a waveform reversed in the potential variation direction, that is, a waveform of which upper and lower portions are reversed.

The invention is not limited to a printer, but is applicable to any liquid ejecting apparatus capable of controlling ejection using a plurality of driving signals. Examples of the liquid ejecting apparatus include various kinds of ink jet printing apparatuses such as a plotter, a facsimile apparatus, and a copy apparatus, a display manufacturing apparatus, an electrode manufacturing apparatus, and a chip manufacturing apparatus. In the display manufacturing apparatus, liquids of various color materials of R (Red), G (Green), and B (Blue) are ejected from a color material ejecting head. In the electrode manufacturing apparatus, a liquid-like electrode material is ejected from an electrode material ejecting head. In the chip manufacturing apparatus, a bio-organism liquid is ejected from a bio-organism ejecting head.

What is claimed is:

1. A liquid ejecting apparatus comprising:

a liquid ejecting head which includes a nozzle ejecting a liquid, a pressure chamber communicating with the nozzle, and a pressure generation unit applying pressure variation to the liquid of the pressure chamber and which ejects the liquid from the nozzle by an operation of the pressure generation unit;

a driving signal generation unit which generates a driving signal containing an ejection driving pulse used to eject the liquid from the nozzle by driving the pressure generation unit; and a movement unit which moves the liquid ejecting head relative to a landing target, wherein a liquid droplet is ejected from the nozzle and is landed on the landing target, while the movement unit moves the liquid ejecting head relative to the landing target, wherein the ejection driving pulse is a voltage waveform including:

a first variation section in which a potential is varied in a first direction to vary a volume of the pressure chamber;

a hold section in which the volume of the pressure chamber varied in the first variation section holds for a given time and a termination potential of the first variation section is constant; and a second variation section in which the potential is varied in a second direction opposite to the first direction to vary the volume of the pressure chamber varied in the first variation section, wherein the second variation section includes:

a first variation component in which the potential is varied in the second direction from the termination potential of the first variation section;

an intermediate hold component in which the termination potential of the first variation component holds for a given time; and a second variation component in which the potential is varied in the second direction from the termination potential of the first variation component, wherein the potential of the intermediate hold component is in the range from 50% to 60% of the potential of the hold section, and wherein a potential inclination of the second variation component is steeper than a potential inclination of the first variation component, wherein a time from an initial end and a termination end of the intermediate hold component is greater than 0 and 0.12 Tc or less on the assumption that a period of pressure vibration occurring in the liquid of the pressure chamber is Tc.

2. The liquid ejecting apparatus according to claim 1, wherein a time from an initial end to a termination end of the second variation component is 0.08 Tc or more.

3. A liquid ejecting apparatus comprising:

a liquid ejecting head which includes a nozzle ejecting a liquid, a pressure chamber communicating with the nozzle, and a pressure generation unit applying pressure variation to the liquid of the pressure chamber and which ejects the liquid from the nozzle by an operation of the pressure generation unit;

a driving signal generation unit which generates a driving signal containing an ejection driving pulse used to eject the liquid from the nozzle by driving the pressure generation unit; and a movement unit which moves the liquid ejecting head relative to a landing target, wherein a liquid droplet is ejected from the nozzle and is landed on the landing target, while the movement unit moves the liquid ejecting head relative to the landing target, wherein the ejection driving pulse is a voltage waveform including:

a first variation section in which a potential is varied in a first direction to vary a volume of the pressure chamber;

a hold section in which the volume of the pressure chamber varied in the first variation section holds for a given time and a termination potential of the first variation section is constant; and a second variation section in which the potential is varied in a second direction opposite to the first direction to vary the volume of the pressure chamber varied in the first variation section, wherein the second variation section includes:

a first variation component in which the potential is varied in the second direction from the termination potential of the first variation section;

an intermediate hold component in which the termination potential of the first variation component holds for a given time; and a second variation component in which the potential is varied in the second direction from the termination potential of the first variation component, wherein the potential of the intermediate hold component is in the range from 50% to 60% of the potential of the hold section, and wherein a potential inclination of the second variation component is steeper than a potential inclination of the first variation component, wherein a time from an initial end to a termination end of the second variation component is 0.08 Tc or more.

* * * * *